US010242603B2

(12) United States Patent
Steer

(10) Patent No.: US 10,242,603 B2
(45) Date of Patent: Mar. 26, 2019

(54) DISPLAY FRAME

(71) Applicant: Gavin Milton Steer, Edenvale (ZA)

(72) Inventor: Gavin Milton Steer, Edenvale (ZA)

( * ) Notice: Subject to any disclaimer, the term of this patent is extended or adjusted under 35 U.S.C. 154(b) by 0 days.

(21) Appl. No.: 15/037,560

(22) PCT Filed: Nov. 19, 2014

(86) PCT No.: PCT/IB2014/066156

§ 371 (c)(1),
(2) Date: May 18, 2016

(87) PCT Pub. No.: WO2015/075643

PCT Pub. Date: May 28, 2015

(65) Prior Publication Data

US 2016/0293066 A1 Oct. 6, 2016

(30) Foreign Application Priority Data

Nov. 19, 2013 (ZA) ..... 2013/04540

(51) Int. Cl.
*G09F 7/00* (2006.01)
*G09F 7/08* (2006.01)
(Continued)

(52) U.S. Cl.
CPC ..... *G09F 7/08* (2013.01); *G09F 7/02* (2013.01); *G09F 9/37* (2013.01); *G09F 13/04* (2013.01);
(Continued)

(58) Field of Classification Search
CPC . G09F 9/37; G09F 9/302; G09F 9/375; G09F 7/12; B41J 2/34; A47G 2001/0666
See application file for complete search history.

(56) References Cited

U.S. PATENT DOCUMENTS 3,740,878 A * 6/1973 Oelschlaeger ..... G09F 9/37 40/447
4,265,040 A * 5/1981 Sarkisian ..... G09F 15/0087 40/606.12

(Continued)

FOREIGN PATENT DOCUMENTS

| | | | |
|---|---|---|---|
| EP | 0 457 987 | A2 | 11/1991 |
| JP | 2011-98023 | A | 5/2011 |
| WO | 2013/030809 | A2 | 3/2013 |

OTHER PUBLICATIONS

Supplementary European Search Report dated Sep. 8, 2017 for EP Application No. 14863160.9.
Patent Abstracts of Japan English abstract of JP 2011-98023 A.

*Primary Examiner* — Cassandra Davis
(74) *Attorney, Agent, or Firm* — Ladas & Parry LLP

(57) ABSTRACT

The invention relates to a display frame for graphic advertising material that is suited for use with a pricing system. The frame has a flat body which is traversed by parallel lipped channels that releasably receive inserts. The frame is moulded from plastics material with webs of the channels provided by connectors. The inserts are configured to display pricing in a manner that allows variation and these allow for pricing changes to be made while the same graphic material is maintained on the display frame. The graphic material may also be provided by inserts and removably secured in the channels. In a preferred embodiment, the frame has movable clamping-rails along outer edges. The clamping-rails are resiliently biased into a closed condition by clips with resiliently deformable cam formations to retain a suitably sized poster and/or transparent screen against the front side of the frame. The clamping-rails and clips for biasing the rails are also moulded from plastics material.

19 Claims, 15 Drawing Sheets

(51) Int. Cl.

| | |
|---|---|
| ***G09F 23/06*** | (2006.01) |
| ***G09F 7/02*** | (2006.01) |
| ***G09F 9/37*** | (2006.01) |
| ***G09F 13/04*** | (2006.01) |
| ***G09F 13/18*** | (2006.01) |
| ***G09F 15/00*** | (2006.01) |
| *G09F 7/18* | (2006.01) |
| *G09F 9/302* | (2006.01) |
| *G09F 7/12* | (2006.01) |
| *G09F 13/22* | (2006.01) |
| *G09F 3/20* | (2006.01) |

(52) U.S. Cl.

CPC ..... *G09F 13/18* (2013.01); *G09F 15/0012* (2013.01); *G09F 23/06* (2013.01); *G09F 3/202* (2013.01); *G09F 7/18* (2013.01); *G09F 9/302* (2013.01); *G09F 15/0018* (2013.01); *G09F 2007/122* (2013.01); *G09F 2007/1843* (2013.01); *G09F 2007/1847* (2013.01); *G09F 2007/1852* (2013.01); *G09F 2013/222* (2013.01)

(56) References Cited

U.S. PATENT DOCUMENTS 4,411,084 A * 10/1983 Kraus ..... G09F 9/37 40/450
4,453,324 A 6/1984 Eenberger
4,498,255 A * 2/1985 Heard ..... A47G 1/0611 40/647
4,817,316 A * 4/1989 Walker ..... G09F 7/10 40/5
4,858,357 A * 8/1989 Thorn ..... G09F 1/02 40/450
4,977,698 A * 12/1990 Seggerson ..... G09F 7/10 40/564
5,027,540 A * 7/1991 Schwarz ..... G09F 7/10 273/281
5,315,775 A * 5/1994 Parker ..... G09F 9/302 40/447
5,392,546 A * 2/1995 Bailey ..... G09F 9/302 40/447
5,481,816 A * 1/1996 Cobb ..... G09F 7/12 40/449
D386,534 S * 11/1997 Odmark ..... D20/43
6,212,807 B1 * 4/2001 Wright ..... G09F 7/12 40/450
6,543,166 B1 * 4/2003 Griffin ..... G09F 7/02 40/618
7,647,717 B2 * 1/2010 Chen ..... G09F 9/375 40/450
8,196,325 B2 * 6/2012 Pitcher ..... G09F 3/20 248/229.1
2001/0054005 A1 12/2001 Hook et al.
2014/0304976 A1 * 10/2014 Krawinkel ..... G09F 7/08 29/592.1

* cited by examiner

DISPLAY FRAME

RELATED APPLICATION

This application is a national phase entry under 35 USC 371 of International Patent Application No. PCT/IB2014/066156 filed on Nov. 19, 2014, which claims priority from South Africa Patent Application No. 2013/04540 filed on Nov. 19, 2013, the entire contents of which are incorporated herein by reference.

FIELD OF THE INVENTION

The invention relates to a frame for displaying graphic material which is useful for advertising and for indicating prices of advertised goods. The invention is particularly suited for use with a beverage pricing system. The invention also relates to a frame of the kind having "snap-rails" at its edges to removably secure a screen of flexible transparent sheet material and/or poster to the front of the frame.

BACKGROUND TO THE INVENTION

Various frames which are commonly used to present replaceable marketing and advertising material are known. Some of these frames are relatively costly with components that are difficult to produce and to assemble. The cost of such frames becomes significant where they are purchased in large numbers for wide-scale use as part of a pricing system. This is generally the case where beverage manufacturers (or other goods/service providers) seek to adopt a given frame or frames as a standard for their merchandising and marketing. The advertising and pricing material used to identify product and display prices must usually be changed or updated with every price variation, special or sale. The replacement of such material also becomes expensive and wasteful.

OBJECT OF THE INVENTION

It is an object of the invention to provide a display frame that is relatively simple to manufacture and which is well suited for use with a pricing system that involves the use of various graphic and printed material and/or other means to identify product and it's pricing.

SUMMARY OF THE INVENTION

In accordance with a first aspect of the invention there is provided a display frame for a pricing system comprising a substantially planar body for display of advertising graphics relating to brands and/or products, the body moulded from plastics material and traversed by spaced apart flanges providing a plurality of parallel, lipped channels to removably receive inserts, the inserts having oppositely disposed, outwardly extending edges locatable beneath opposing lips provided by one or more of the channels, and in which the inserts comprise:

pricing inserts i. which include a substantially rigid plastics material chassis that carries a variable pricing array of digital-eight digits, which digits are rotatably supported by the chassis with opposite sides provided in different colours to mark or unmark a digit in a digital-eight; and/or ii. which include strip sheets of flexible planar material printed with a variable pricing array of digital-eight digits, which digits are provided in a light colour with a dark background to mark all the digits in a digital-eight and which digits can be unmarked with a dark ink marker.

The invention further provides for a display frame as defined in which the inserts further comprise:

graphic inserts:

i. which include strip sheets of flexible planar material printed with graphics relating to products; and/or ii. which include a substantially rigid plastics material chassis carrying graphic material relating to products.

A further feature of the invention provides for a display frame as defined in which the inserts are provided in different sizes to fit into a channel or to fit across two or more channels.

A further feature of the invention provides for a display frame as defined with at least two oppositely disposed hingeable clamping-rails, the body including peripheral sidewalls for location of the clamping-rails, the clamping-rails each having a free, clamping edge and a hinged edge movably securable to the body with a lug formation, providing oppositely disposed first and second flanges, which locates through a slot provided between the body and sidewall, the first flange extending forwardly to engage an edge of the slot provided by the sidewall and the second flange extending through the slot to a rear side of the body with a spring biased cam formation which supports the second flanges in a position corresponding to a closed condition of the respective clamping-rails and provides an interference path for the second flanges as the respective clamping-rails are moved from the closed condition towards an open condition.

Further features of the invention provide for a display frame as defined: in which the clamping-rails secure a flexible transparent screen and/or poster against the body; and in which the clamping-rails secure a flexible sheet of material including graphics relating to products against the body, with the flexible sheet including transparent windows or cut-outs located around the pricing inserts.

In accordance with another aspect of the invention there is provided a display frame comprising a substantially planar body moulded from plastics material, with at least two oppositely disposed hingeable clamping-rails, the body including peripheral sidewalls for location of the clamping-rails, the clamping-rails each having a free, clamping edge and a hinged edge movably securable to the body with a lug formation, providing oppositely disposed first and second flanges, which locates through a slot provided between the body and sidewall, the first flange extending forwardly to engage an edge of the slot provided by the sidewall and the second flange extending through the slot to a rear side of the body with a spring biased cam formation which supports the second flanges in a position corresponding to a closed condition of the respective clamping-rails and provides an interference path for the second flanges as the respective clamping-rails are moved from the closed condition towards an open condition.

The invention further provides for a display frame as defined in which the frame is traversed by spaced apart flanges providing a plurality of parallel, lipped channels to removably receive inserts having edges locatable beneath lips of the channels. This aspect of the invention further provides for the inserts to comprise:

pricing inserts i. which include a substantially rigid plastics material chassis that carries a variable pricing array of digital-eight digits, which digits are rotatably supported by the chassis with opposite sides provided in different colours to mark or unmark a digit in a digital-eight; and/or ii. which include strip sheets of flexible planar material printed with a variable pricing array of digital-eight digits, which digits are provided in a light colour with a dark background to mark all the digits in a digital-eight and which digits can be unmarked with a dark marker pen;

and graphic inserts:

i. which include strip sheets of flexible planar material printed with graphics relating to products; and/or ii. which include a substantially rigid plastics material chassis carrying graphic material relating to products.

Both aspects of the invention provide for a display frame as defined: in which flanges of the channels are connected by a network of connectors providing perforated channel webs; and in which a planar front facing surface provided by the connectors in the channels is formed by a first injection mould die and for overlying lips that extend along the edges of the flanges to be formed by a second die which extends through the flanges and connectors from a rear side of the frame.

Further features of the invention provide for a display frame as defined: in which the cam formations are configured and arranged to act against the second flanges with a relatively small bias when the respective clamping-rails are in a closed condition and provide an increasing bias against movement of the respective clamping-rails towards the open condition; in which the cam formations provide a continuous resisting bias as the second flanges are moved towards an over-centre point and for the bias to switch towards movement of the second flanges into a position corresponding to the open conditions of the respective clamping-rails when the second flanges are moved past the over-centre point; in which the cam formations are each provided by a spring clip moulded integrally from resiliently flexible plastics material; and in which the clips are moulded with a substantially flat base to one side, locatable against the frame body, and a rearwardly curved tongue providing the cam formation.

Further features of the invention provide for a display frame as defined: in which the frame body has a clip mounting adjacent each slot with a stop arranged opposite the slot on the body to support the cam formation for interference engagement with the second flange and a pair of side-supported shoulders between the stop and the slot under which the clip is locatable; in which each clip has a rearwardly extending, transverse flange that locates against the side-supported shoulders; in which the side-supported shoulders of the clip mountings are formed by the first die that extends through openings in the frame from a front side and lugs providing the side-supported shoulders are formed by a second die on the opposite, rear side of the frame.

Further features of the invention provide for a display frame as defined: in which the clamping-rails are moulded from plastics material; and in which the frame is rectangular with four hingeable clamping-rails and four sidewalls, one along each edge of the frame.

In accordance with another aspect of the invention there is provided a variable pricing insert for use with a display frame as defined above providing a lipped channel to receive an insert, the insert comprising a substantially planar chassis moulded from plastics material to be of substantially rigid construction and having a pair of operatively rearwardly extending flanges along opposite parallel sides of the chassis, each flange provided with an outwardly extending lip for location beneath oppositely disposed cooperating lips in a lipped channel provided on a display frame.

This invention further provides for an insert as defined in which the chassis is sufficiently resilient and deformable across a portion thereof located between the flanges for insertion past the oppositely disposed lips of and retention within the lipped channel of the display frame.

The invention further provides for an insert as defined: which provides variable pricing means include an array of digital-eight digits, which digits are rotatably supported by the chassis with opposite sides provided in different colours to mark or unmark a digit in a digital-eight; in which each digit is located in a corresponding opening through the chassis having an axle for the digit moulded across the opening, each digit comprises a first half of light coloured plastics material and a second half of dark coloured plastics material with the chassis moulded from a corresponding colour dark or light plastics mater, and the first and second halves of the digit configured to form a passage over the axle and sonically welded into engagement; and in which each digit has a longitudinal recess formed between opposite halves with edges of the digit on either side of the recesses providing an interference fit through the opening in the chassis to retain location of the digit in an operative position within the opening.

BRIEF DESCRIPTION OF THE DRAWINGS

These and other features of the invention will become more apparent from the following description of one embodiment, made by way of example only, with reference to the accompanying drawings, in which.

DETAILED DESCRIPTION OF THE INVENTION

Figure 1:
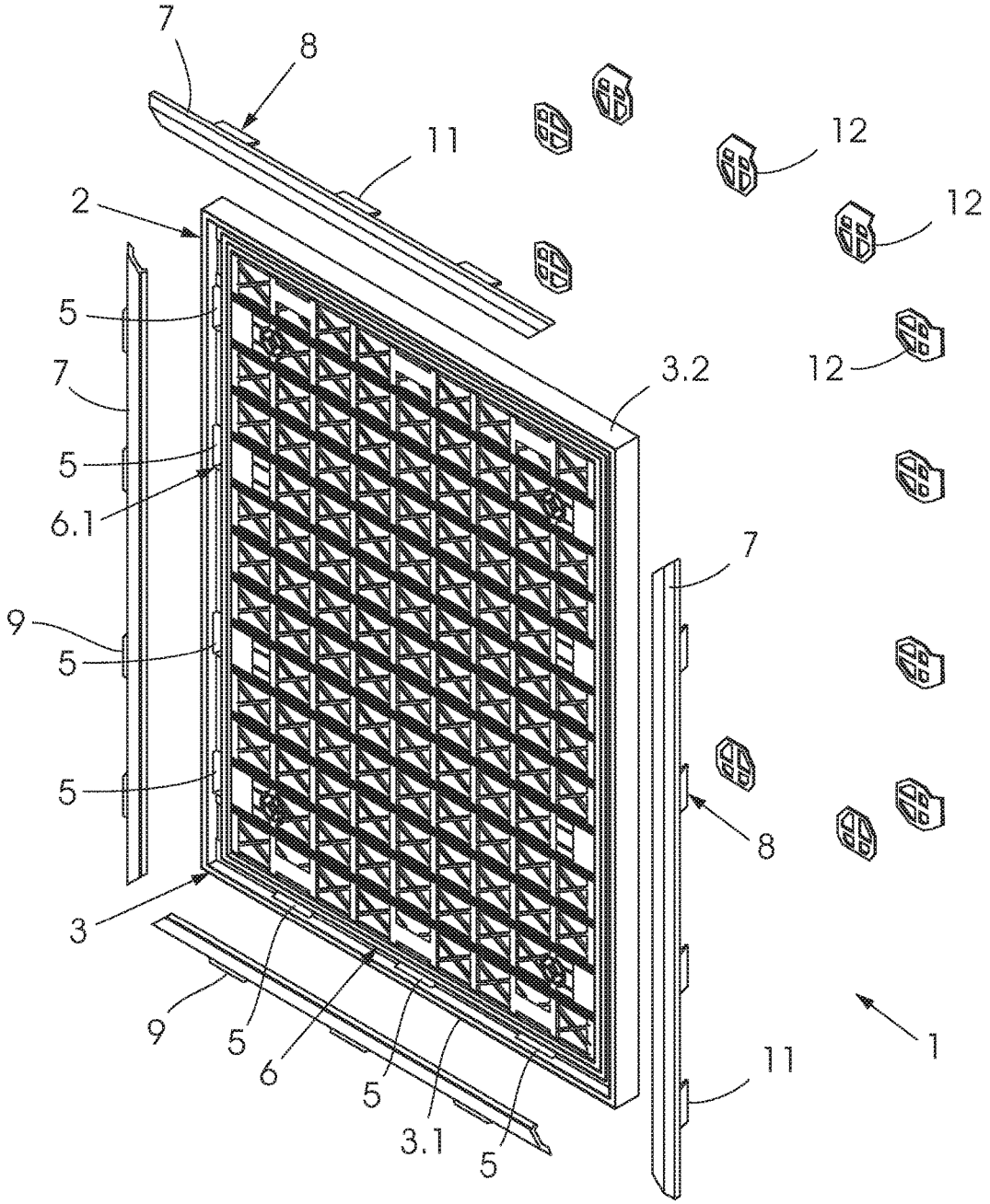
FIG. 1 shows a perspective, exploded view of a display frame in accordance with the invention.
Figure 2:
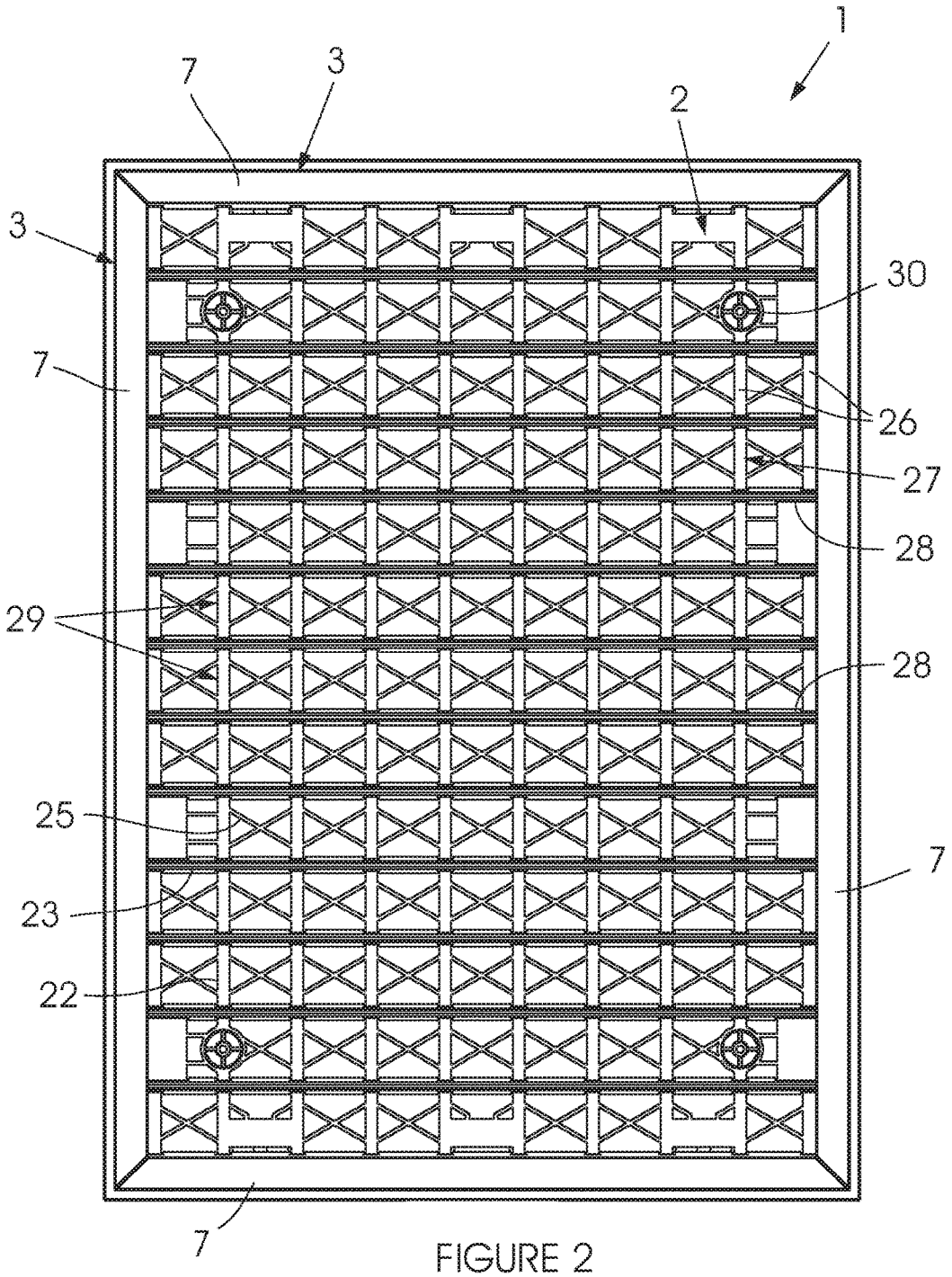
FIG. 2 shows a front view of the frame in FIG. 1.
Figure 3:
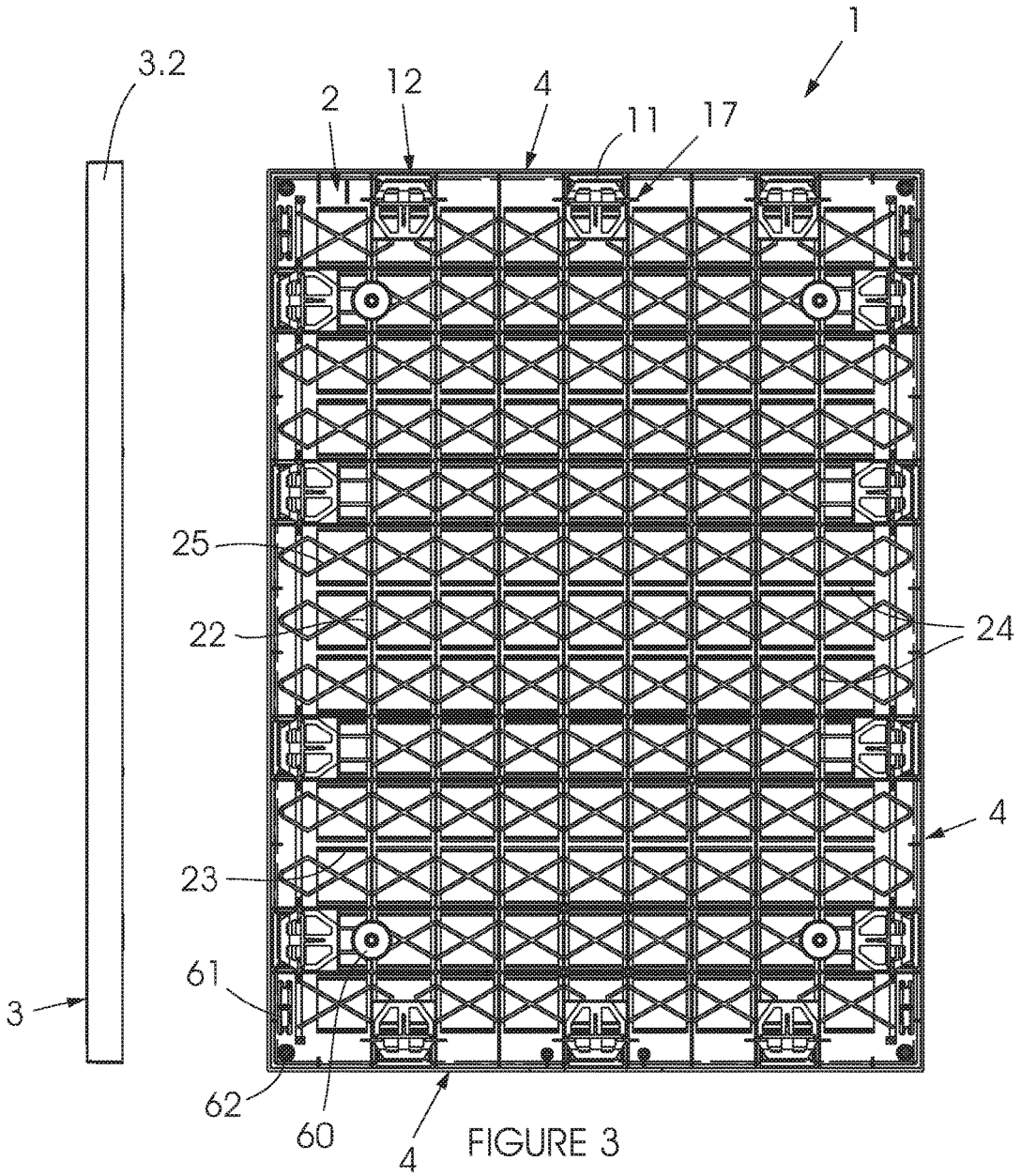
FIG. 3 shows a side view and a rear view of the frame in FIG. 1.
Figure 4:
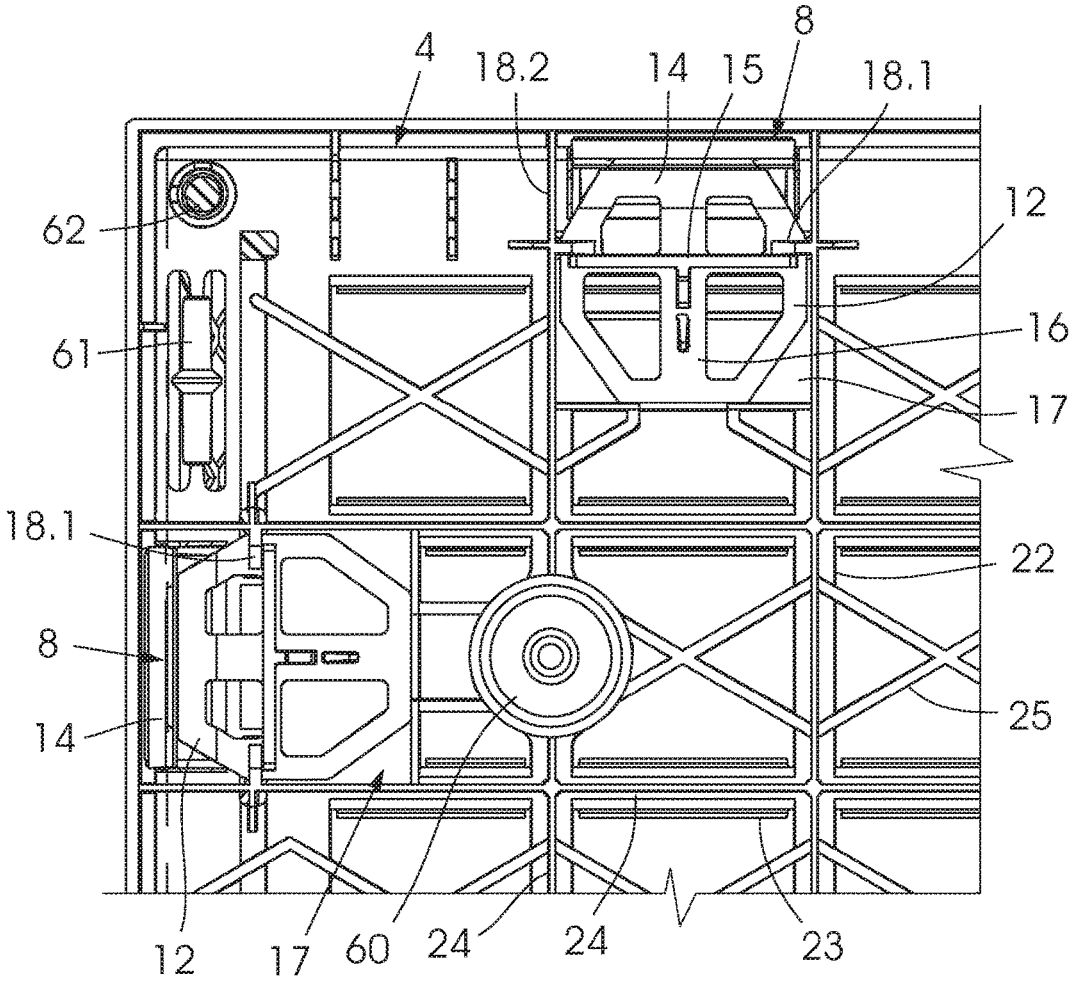
FIG. 4 shows an enlarged view of the top left rear corner of the frame, taken from FIG. 3.

Referring to the FIGS. 1 to 8, a display frame is indicated generally by reference numeral (1). The frame (1) has a substantially planar, rectangular body (2). The body (2) is injection moulded from a plastics material. This will preferably incorporate a component of plastics material from recycled bottle crates. The material is mixed with additives and other suitable raw plastics material to provide a composition that can be injection moulded.

The advantage is that beverage manufacturers generally have a surplus of such waste material in the form of spent crates. When this material is processed, there is limited use for it. The invention allows the use of such material in the manufacture of a product that can then go back into the industry that generated the waste.

A forwardly protruding hollow ridge (3) extends around the frame (1) providing a front edge with sidewalls (3.1) along the four sides of the frame (1) provided by an inner wall of the hollow ridge (3). An outer wall (3.2) of the ridge (3) forms a rearwardly extending skirt around the outside of the frame (1). The inside of the ridge (3) is moulded as a groove (4) open to a rear side of the body (2)—see FIGS. 3 and 4.

Spaced apart slots (5) are provided in a recess (6) that extends along an inner side of the ridge (3) against the sidewall (3.1). Four spaced apart slots (5) are provided along each of the two (long) sides of the frame (1). Three such slots (5) are provided along each of the top and bottom of the frame (1).

The recess (6) is formed between the sidewall (3.1) and a continuous flange (6.1) spaced apart to the inside and extending to the front side of the frame (1). The slots (5) extend from a base of the flange (6.1) across the recess (6) and partway up the sidewall (3.1). The recess (6) adjacent the ridge (3) along each edge of the frame (1) receives an elongate, hingeable clamping-rail (7). The clamping-rails (7) have lug formations (8) corresponding to the slots (5).

The formations (8) each have a forwardly extending flange (9) which engages through the slots (5), behind the ridges (3). The forward flange (9) locates in the groove (4) behind the ridge (3) when extending through the slot (5). This overlapping engagement pivotably retains the outer edges of the clamping-rails (7) which carry the formations (8) against or adjacent the ridges (3). The forward flange (9) engages a slot edge (10) formed along the inner wall (3.1) of the ridge (3) to provide a fulcrum for an oppositely extending, rearward flange (11) that protrudes through the slot (5), away from the ridge (3).

The oppositely protruding flanges (forward and rearward) are slightly offset but located in substantially parallel planes.

Once assembled, a resilient spring clip (12) is located in line with and adjacent each slot (5) on the rear side of the frame body (2). The clips (12) are moulded from acetyl. This material is less susceptible to loss of flexible resilience due to heat exposure. The condition occurs where the frame (1) is, for example, used in direct sunlight.

The clips (12) have a flat base (13) with an upwardly curved tongue providing the cam formation (14) at a working end. The base (13) has (when viewed from a rear side) a "T-shaped" flange (15) that extends rearwardly from the frame body (2), in use, and laterally from a longitudinally extending, central portion (16) of the base (13). The portion (16) extends from the tongue formation (14) along the length of the clip (12). Two side connectors (16.1) extend from the from the tongue formation (14) to side edges of the flange (15) and on to the opposite end of the clip (12) where they connect to the central portion (16). The clip (12) (viewed from the front or rear) has a substantially octagonal form with two pairs of symmetrical cutouts in the base (13) and the curved cam formation (14) formed along one side of the octagon.

A mounting (17) for each clip (12) is provided on the rear side of the frame body (2), located inwardly of the respective slots (5). The free end of the cam formation (14) is inserted and fed under a pair of side-supported, spaced apart shoulders (18) located under lugs (18.1) oppositely disposed at the sides of the mounting (17) and in close proximity to the body (2) inside the mounting (17). The base (13) of the clip (12) bends during insertion and when the flange (15) of the clip (12) abuts the lugs (18.1), a back end of the clip (12) falls into place [under bias of the resilience of the clip (12) material] and locates against a pair of stops (19), provided by two spaced apart flanges (19.1) at the end of the mounting (17) opposite to the slot (5). This retains the clip (12) in the mounting (17) under the shoulders (18) and against the stops (19). The central portion (16) has an opening (20) which fits over a protrusion (21), located inside the mounting (17).

The lugs (18.1) are provided on sidewalls (18.2) of the mounting (17) [which are formed as extensions of reinforcing rib formations (24) that crisscross the rear side of the body (2)].

The clips (12) are thus anchored to the body (2) with the cam formations (14) supported adjacent the slots (5) to the rear of the frame (1). This is done after the clamping-rails (7) have been fitted to the frame (1), with the lug formations (8) extending through the respective slots (5) and the clamping-rails (7) in a closed condition. Once assembled, the free ends of the protrusions (21) can be melted to lock the clips (12) in the mountings (17).

With the clips (12) in place, the cam formations (14) are disposed to interact with the rearward flanges (11) of the lug formations (8) as described below. The clamping-rails (7) are movable or can be flapped between an open condition and a closed condition. The cam formation (14) of the spring clip (12) provides an over-centre bias, locating mechanism which retains the clamping-rails (7) in either condition.

In the closed condition, the cam formation (14) provides a slight bias against the rearward flange (11). The degree of bending of the spring clip (12) is selected to hold the clamping-rail (7) closed, with sufficient reactive force to clip or hold down, under the edges of the clamping-rails (7), the borders of a transparent flexible screen (and/or a poster) arranged on the front of the frame (1). The clamping-rails (7) rest against free ends of the flanges (6.1) and each have an inwardly disposed rib (7.1) that locates against the body (2) of the frame (1) in this condition.

The shape of the curved cam formation (14) determines that in the closed condition of the clamping-rails (7) there is only a relatively small load on the material of the spring (12) and provides for an increase in the reactive bias when the clamping-rails (7) are moved from the closed condition towards an open condition [up to a centre-point in the cooperating geometry of the rearward flange (11) and the curved, spring cam formation (14)]. This arrangement serves to extend the life of the springs (12) by avoiding or at least minimizing the load to which the springs (12) are subjected when in a static, in use closed condition.

Figure 5:
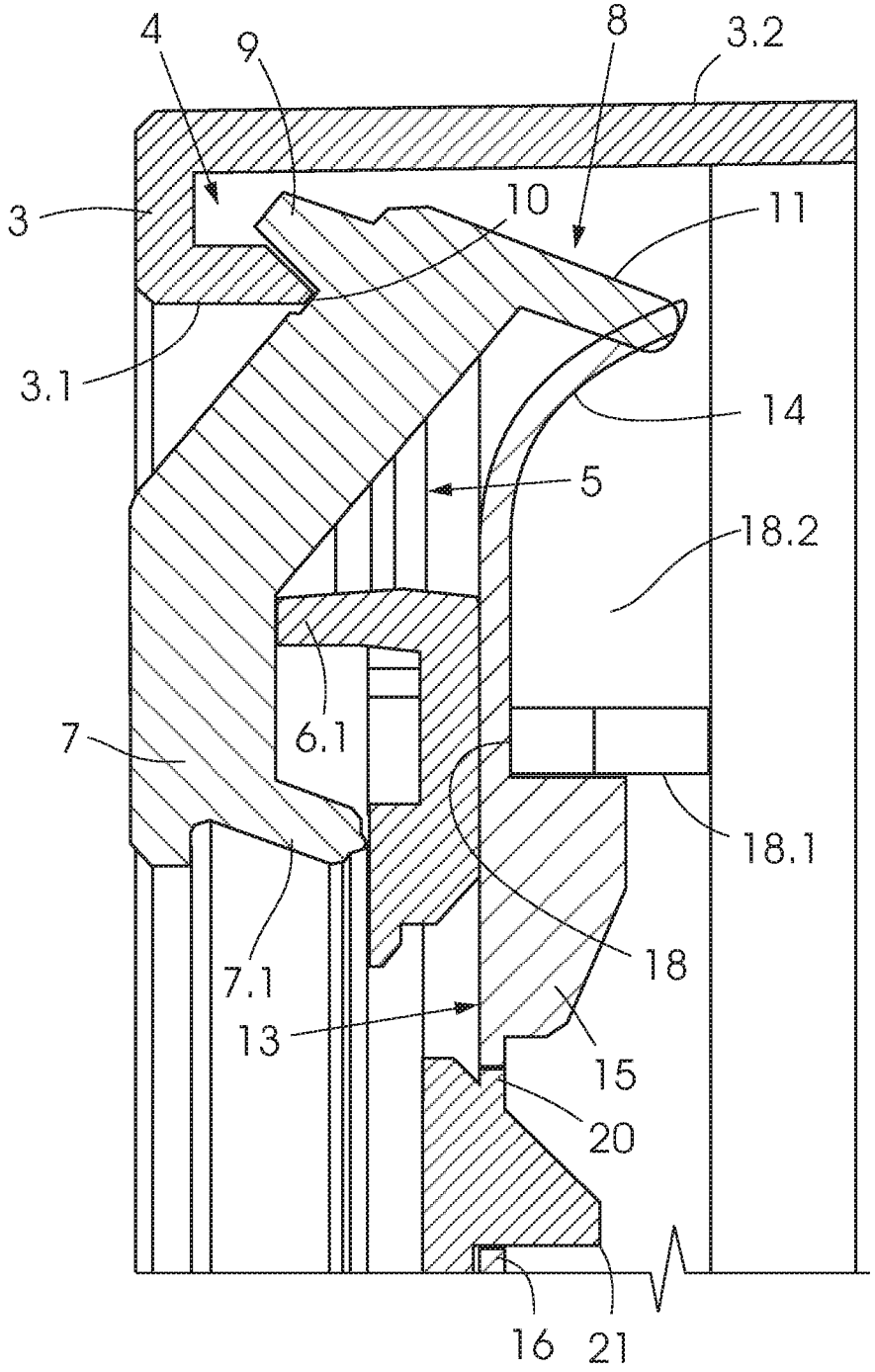
FIG. 5 shows a side, cross-sectional view through a spring clip supporting a clamping-rail in a closed condition.
Figure 6:
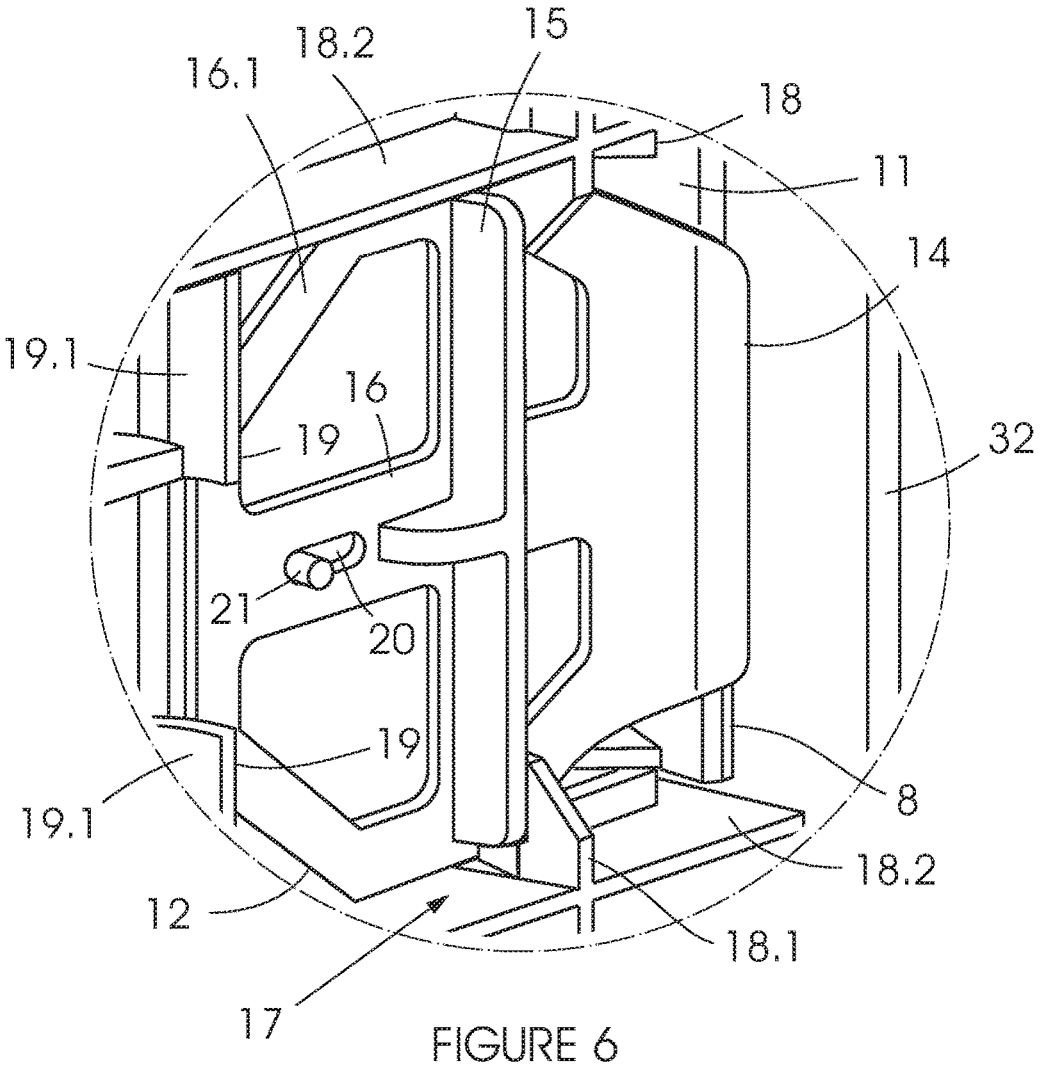
FIG. 6 shows a perspective, rear view of the clip in FIG. 5.

The clips (12) are shown with the clamping-rails (7) in the closed condition in FIGS. 5 and 6. These drawings illustrate the cams (14) and rearward flanges (11) overlapping the same space. The illustration is based on the position each component would occupy if the other were not there to interact with. This form of illustration will be understood by one skilled in the art.

Figure 7:
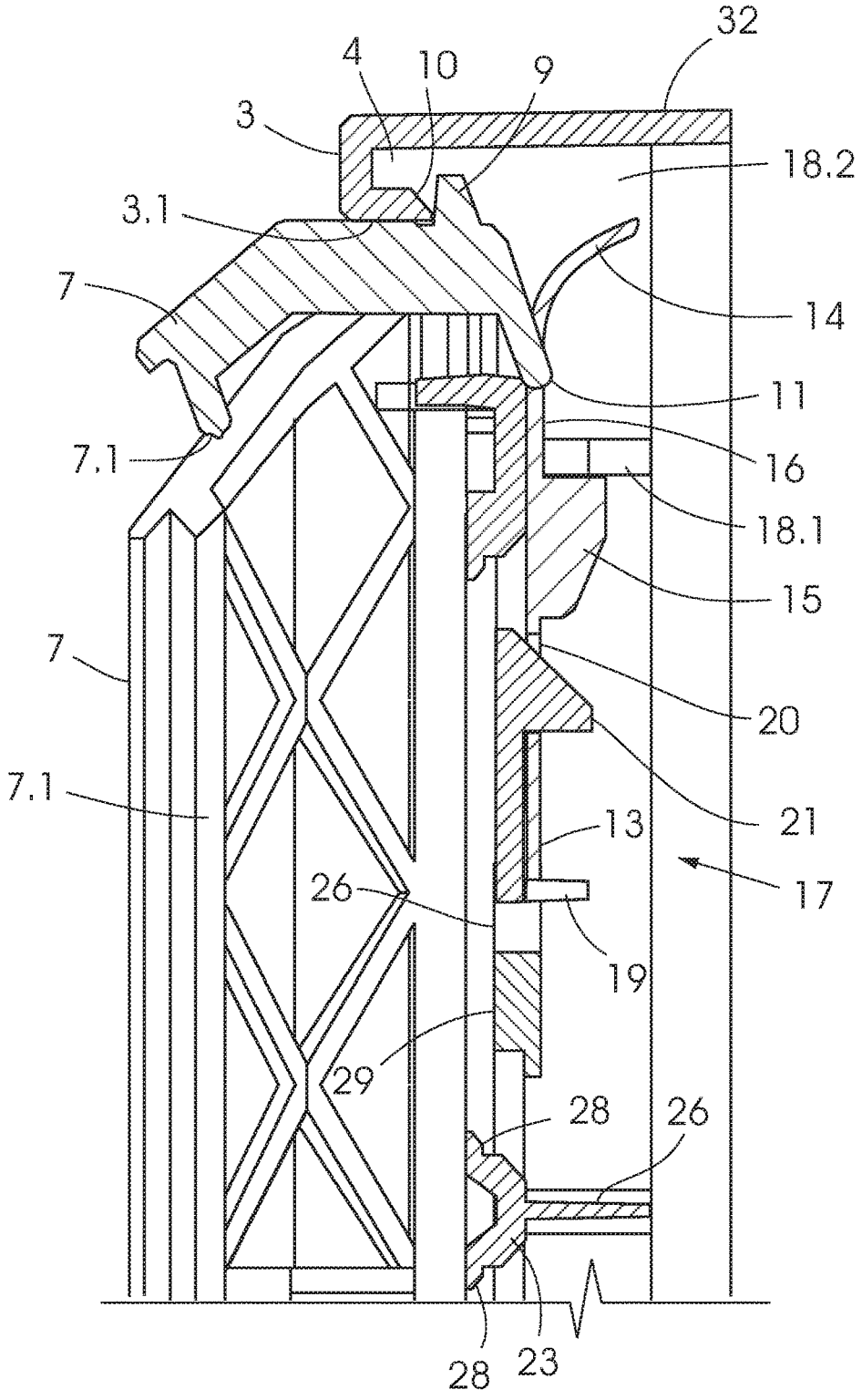
FIG. 7 shows a side, cross-sectional view through a spring clip supporting a clamping-rail in an open condition.
Figure 8:
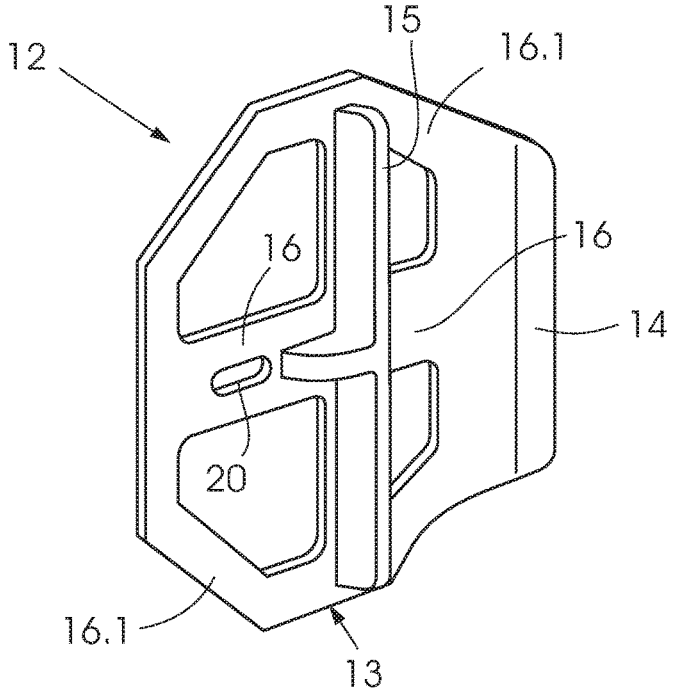
FIG. 8 shows a perspective view of a spring clip

FIG. 7 shows the same overlapping view of the components but with the clamping-rail (7) moved into an open condition. The rearward flange (11) displaces the cam formation (14) against its resilient bias as its edge slides along the working surface of the cam formation (14). Once the edge of the flange (11) has passed the centre-point in the cooperating geometry of the cam (14), the spring (12) serves to bias the flange (11) and clamping-rail (7) into the open condition. The flange (1) moves under the cam formation (14), which serves to hold or maintain it in that position with the rearward flanges (11) against the body (2) which corresponds to the open condition of the clamping-rail (7).

The clamping-rails (7) are thus provided with an over-centre clip action that provides a resilient bias from the cam formation (14) to either side of the centre-point in the cooperating geometry of the rearward flange (11) and cam formation (14). The arrangement provides the clamping-rails (7) with a "snap" action, when moved from one condition to the other, once the flange (11) passes the over-centre point of the cam formation (14).

The clamping-rails (7) are kept in an open condition for limited periods of time and not when the frame (1) is ordinarily in use. The load on the spring material when it is in this condition is therefore of little or less significance to its useful life.

This embodiment of the invention provides a cost effective "snap-rail" type frame. The frame comprises one body and four clamping-rails which are easily fitted together. Sliding the spring clips into place completes assembly of the frame. The whole operation should take little more than a minute. The frame also avoids the use of aluminium, which is commonly stolen for sale as scrap metal and the usual use of steel or alloy for spring components. The frame is made from four moulds: one for the body; one for each of the long (side) and short (top and bottom) clamping-rails; and one for the clips.

The more significant part of the body (2) to the inside of the formations described above is perforated to limit the use of plastic material but moulded as a substantially symmetrical, repeated-pattern network providing sufficient structural strength and the formations on this part of the body (2) that are described below.

The body (2) of the frame (1) is accordingly moulded with spaced apart connectors parallel to its side edges (upright connectors) and spaced apart flanges parallel to its top and bottom edges (transverse flanges). Both the upright connectors (22) and transverse flanges (23) have reinforcing ribs (24) which run along their entire length to the rear side of the frame (1). The upright connectors (22) also have bracing (25) provided as "X-shaped" cross-connectors extending therebetween.

To the front of the frame (1), the upright connectors (22) and cross-bracing (25) provide a flat, perforated backing structure (26) between the transverse flanges (23). A planar front facing surface (27) of the backing structure (26) is formed by a first die. This die is inwardly stepped along the transverse flanges (23) and a second die (which forms the rear of the frame) fits through the upright connectors (22) and bracing (25) to form overlying lips (28) that extend along the transverse flanges (23) between the upright connectors (22).

The first die also extends from the front of the frame (1) through slots in the frame body (2) formed against the sidewalls (18.2) of the mountings (17) to provide the first pair of side-supported, shoulders (18) on the underside of the lugs (18.1) that locate the clips 12) against the frame (1) in the mountings (17). The second die forms the lugs (18.1) and other features of the mountings (17) from the opposite, rear side.

The display frame (1) is accordingly traversed by spaced apart flanges (23) providing parallel, lipped channels (29) to removably receive inserts having oppositely disposed, outwardly extending edges locatable beneath lips (28) of the channels (29).

More specifically and as illustrated in the remaining drawings, the channels (29) are used to retain inserts (30) that have top (31) and bottom (32) edges locatable under the lips (28) of the channels (29) between the transverse flanges (23) with the flat backing structure (27) providing webs of the channels (29). In this description, the embodiments of the invention are illustrated for use with a pricing system for beverage bottles and cans of various volumes.

Figure 9:
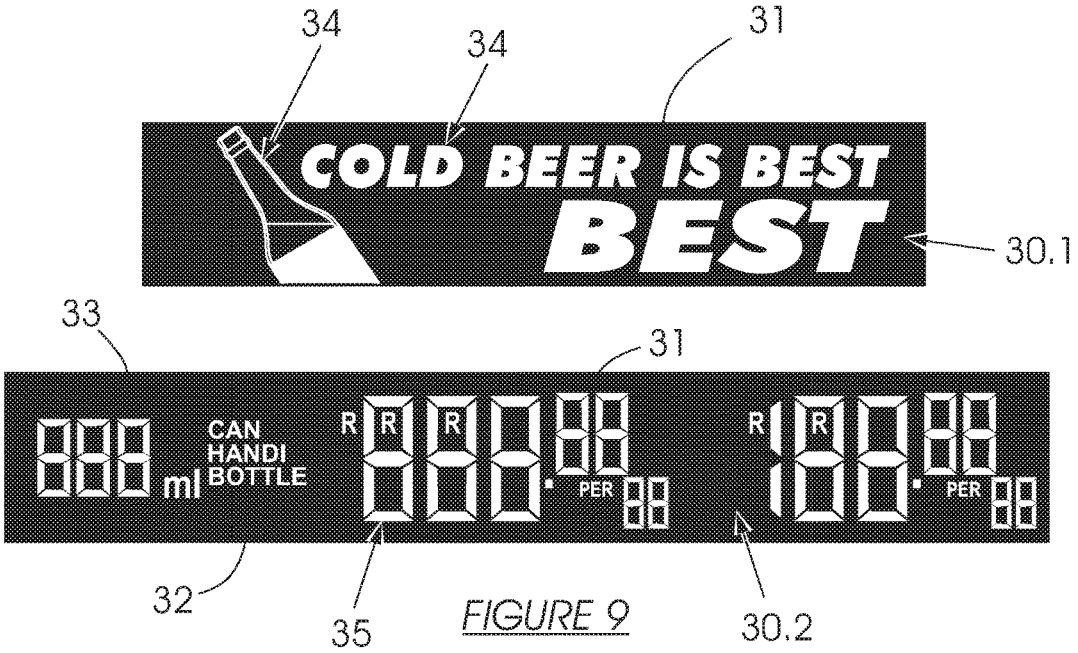
FIG. 9 shows a front view of a graphic insert and a pricing insert.
Figure 10:
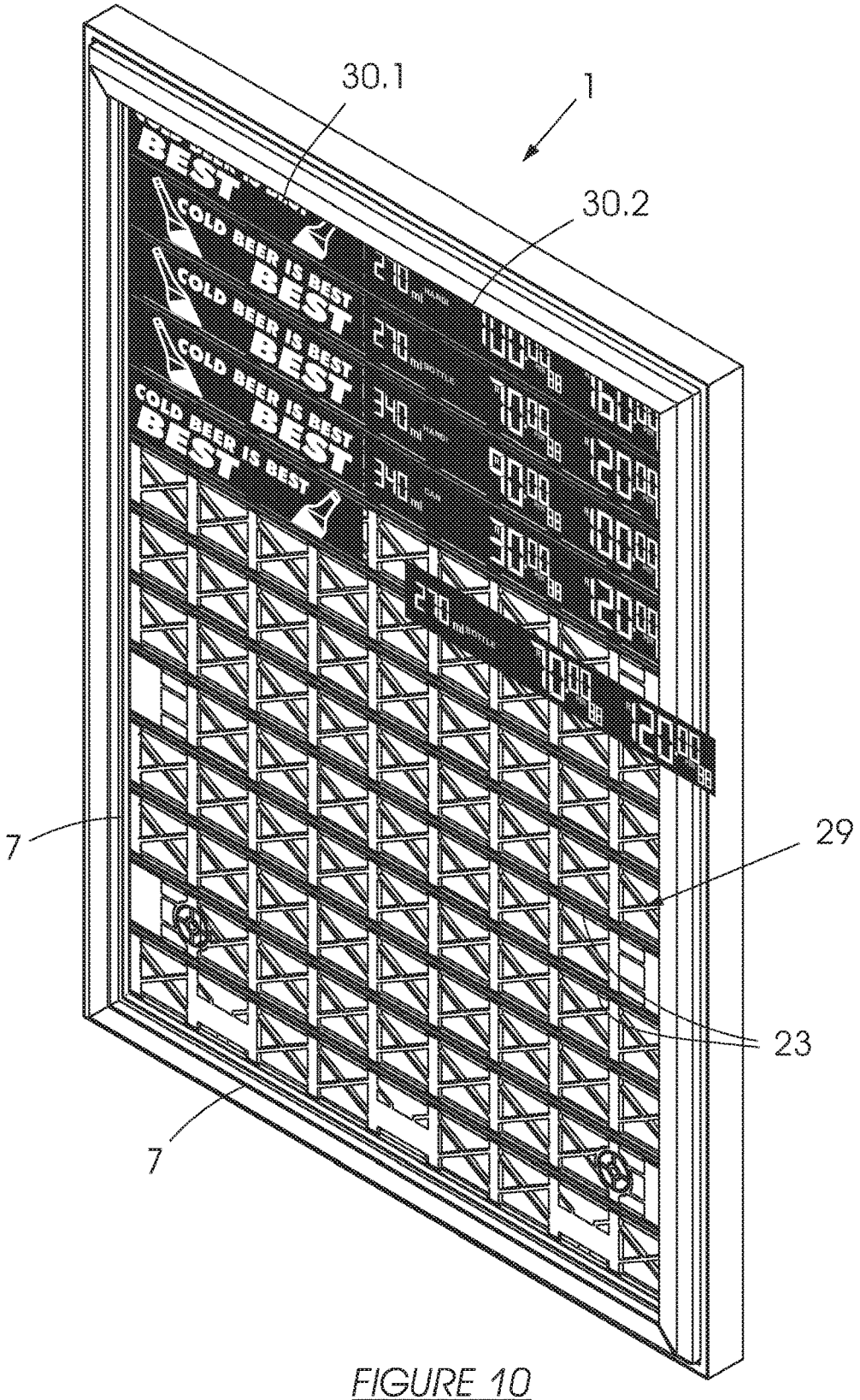
FIG. 10 shows inserts of the kind in FIG. 9 fitted to the frame of FIGS. 1 to 8.

Referring to FIGS. 9 and 10, the inserts (30) comprise:

graphic inserts (30.1) which include strip sheets of flexible planar material (33) printed with graphics (34) relating to products;

and pricing inserts (30.2) which include strip sheets of flexible planar material (33) printed with a variable pricing array of digital-eight digits (35), which digits are provided in a light colour with a dark background to mark all the digits in a digital-eight and which digits can be unmarked with a dark ink marker pen.

In the example of FIG. 10, graphic inserts (30.1) showing brands (or otherwise describing a product that is offered for sale) can be arranged down the left half of the frame (1). On the right half can be pricing inserts (30.2) which show beverage container volume, type (can or bottle and volume) and price. Price specials can also be displayed along a given line provided by channel (29) and also details of a saving when the beverage container is on special.

The frame (1) is obviously not limited to use with such inserts (30). A suitably sized poster can also be clipped in place, with or without a transparent cover screen. One frame with a poster can also be used adjacent a second frame that is fitted with the graphic (30.1) and pricing (30.2) inserts.

A screen with printed material and suitably positioned transparent "windows" (or cut-outs) can be used in combination with pricing inserts (30.2) supported underneath in the channels (29) as described. The information on the pricing inserts (30.2) can be changed while the surrounding graphic on the overlying sheet is re-used.

In a variation of these examples, a first frame can be used with a poster showing an image of a beverage (such as a soft-drink) with a meal that are offered together as a main special along with details of the price for the illustrated combination. A second frame can be used adjacent the first with strip inserts down the left hand side indicating various other meals to be sold in combination with the soft drink advertised and with the container details and volume and the price of each variation of the combination indicated by suitable strip inserts down the right hand side of the second frame. The inserts describing the meals can be provided separately for different food items that can be combined by the owner of an establishment, for example: "sausage";

"bread roll"; "burger"; "pie"; "French fries"; "cheese"; "gravy"; "soup", and so on. The pricing inserts will be variable for the owner to elect and mark a chosen price for each combination.

Figure 11:
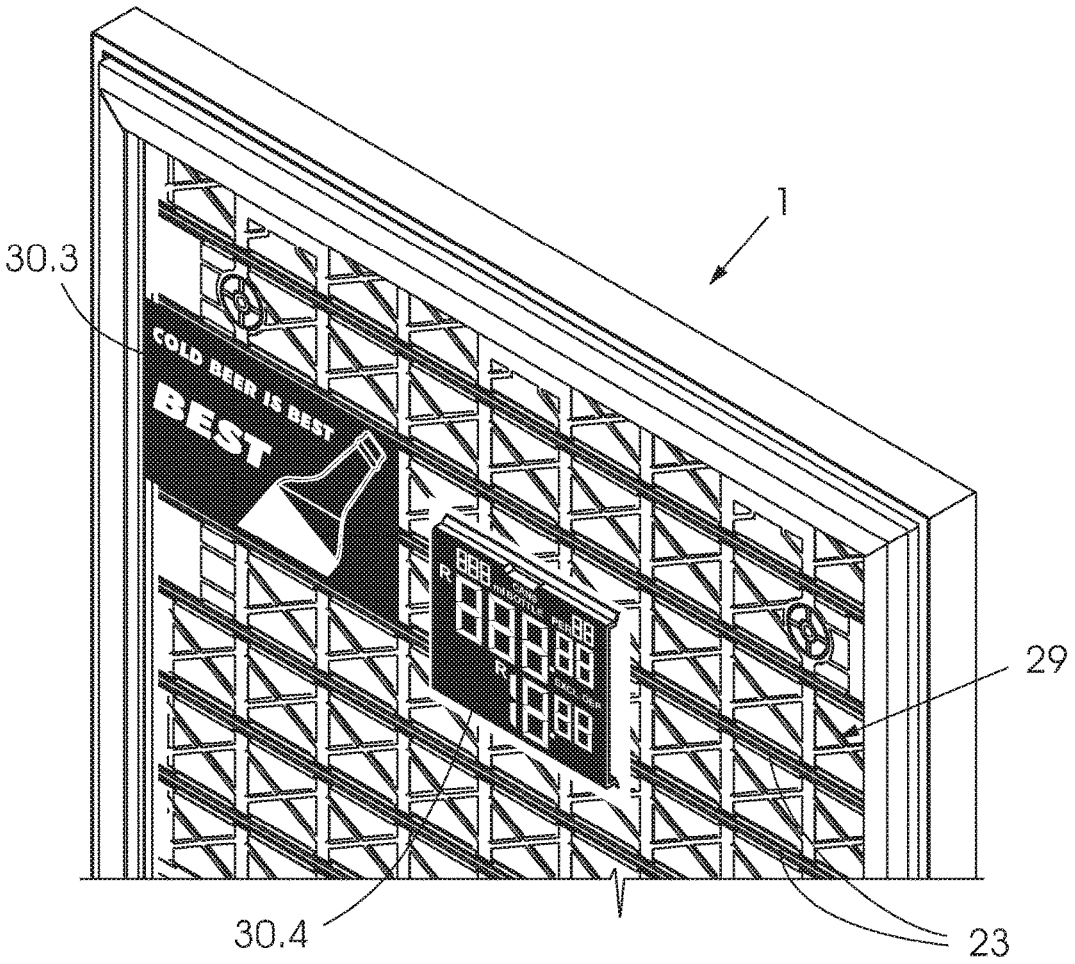
FIG. 11 shows the frame of FIGS. 1 to 8 with alternative inserts.
Figure 12A:
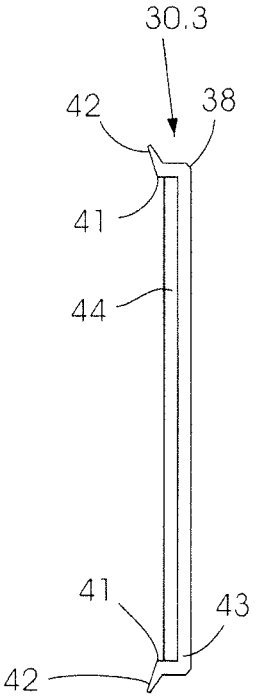
FIGS. 12 *a* to *c* show details of the alternative inserts.
Figure 12B:
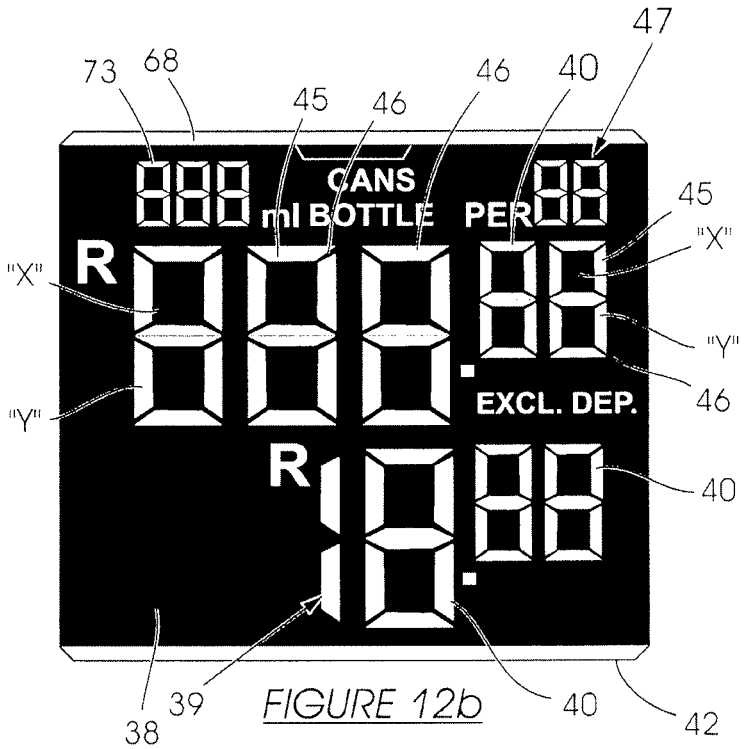
Figure 12C:
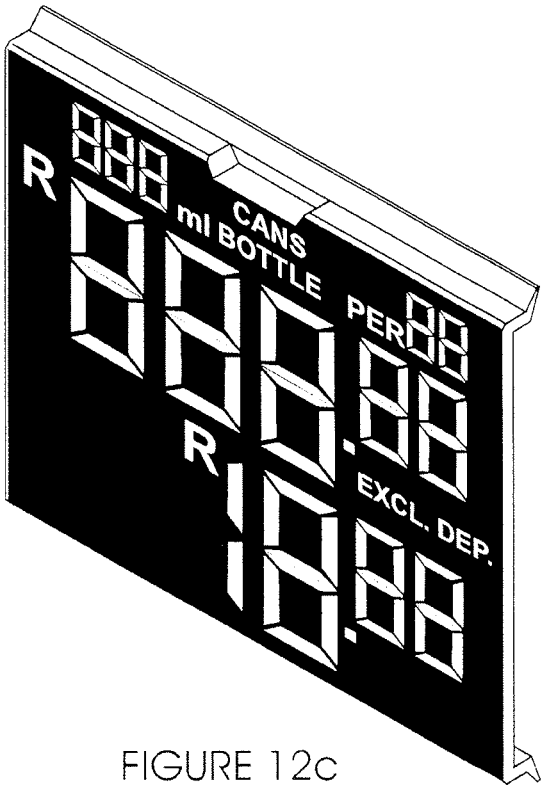

In FIGS. 11 and 12, the use of alternative inserts (30) is illustrated and these comprise:

graphic inserts (30.3) which include a substantially rigid plastics material chassis (36) carrying graphic material (37) relating to products;

and pricing inserts (30.4) which include a substantially rigid plastics material chassis (38) that carries a variable pricing array of digital-eight digits (39), which digits (40) are rotatably supported by the chassis (38) with opposite sides provided in different colours to mark or unmark a digit in a digital-eight (39).

Figure 13:
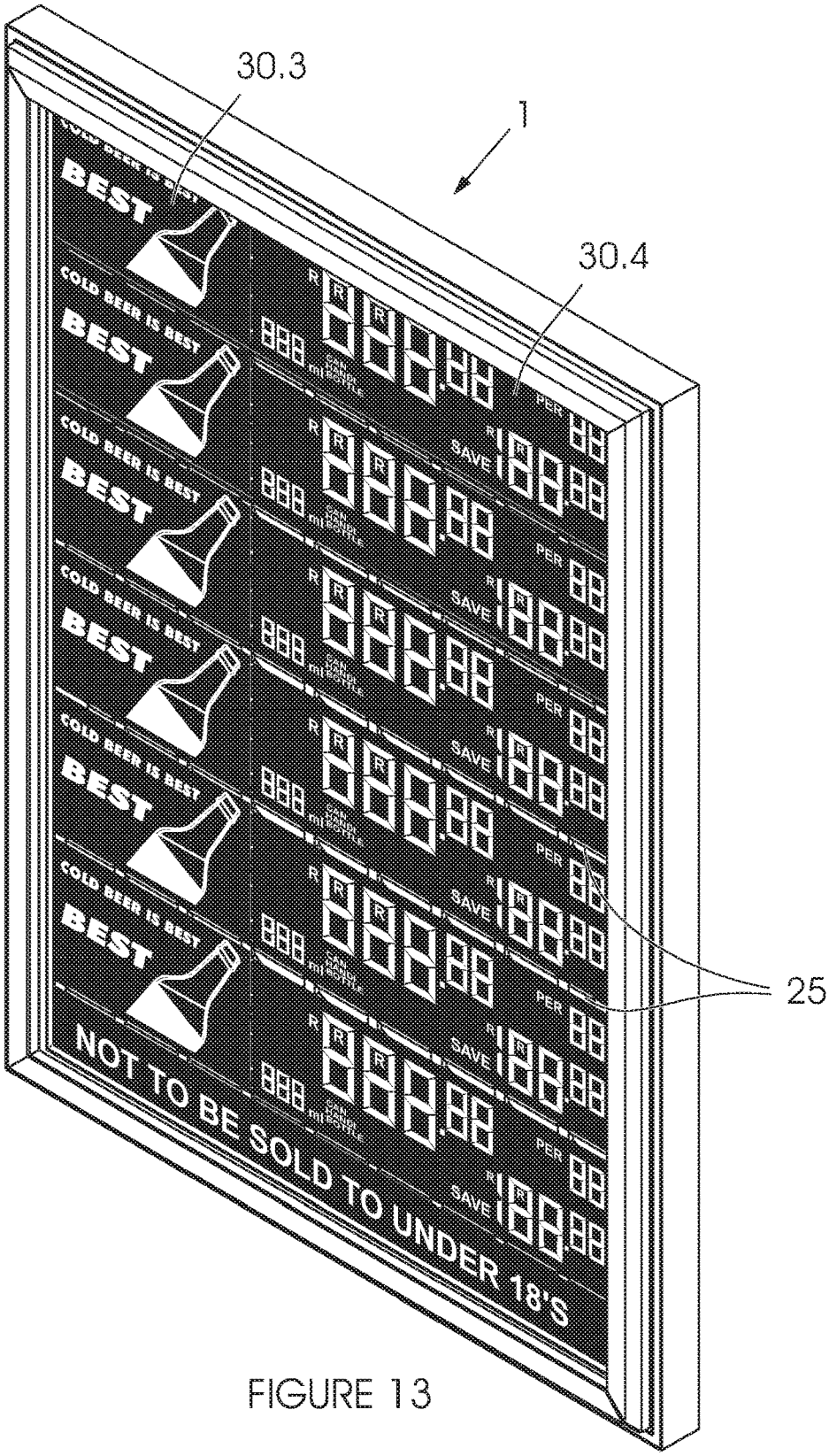
FIG. 13 shows the frame of FIGS. 1 to 8 with alternative pricing inserts.

The chassis (36; 38) of each insert shown is provided in a size that fits across two lipped channels (29) in FIGS. 11 to 13.

Referring more specifically to FIG. 12*b*, the pricing insert (30.4) includes a pair of operatively rearwardly extending flanges (40) along opposite parallel sides of the chassis (38) with an outwardly extending lip (41), each providing an edge, for location beneath oppositely disposed cooperating lips (28) in the lipped channels (29) of a display frame (1). The chassis (38) is sufficiently resilient and deformable across a portion thereof located between the flanges (40) for insertion past the oppositely disposed lips (28) of and retention within the lipped channel (29) of the display frame (1).

The chassis (38) is provided with a front panel (42) and sidewalls (43) that connect the top and bottom flanges (40). The sidewalls (43) are shorter than the flanges (40). Where the chassis (38) is sized to extend across two (or more adjacent channels), the flanges (40) support the sidewalls (43) on an underside of the chassis (38) over the unused channel rail (or rails) across which the chassis (38) extends. (Alternatively, a suitably located slot may be provided in the operatively underside of a chassis to straddle an unused channel rail.)

The chassis (36) of the graphic insert (30.3) has the same configuration but is formed without the openings for the digital-eights (39) described below. The chassis (36) is also sufficiently resilient and deformable to fit past the lips (28) of the channels (29). The side profile is as illustrated in the cross-sectional view of FIG. 12*a*.

The variable pricing means (39) includes an array of digital-eight digits (40), which digits (40) are rotatably supported by the chassis (38) with opposite sides provided in different colours (indicated "x" for dark and "y" for light) to mark or unmark a digit (40) in a digital-eight (39).

Each digit (40) is located in a corresponding opening (45) through the chassis panel (43) having an axle (46) which is moulded across the opening (45) to support the digit (40). The digits (40) from two of the digital-eights (39) have been removed from the front view of FIG. 12*b* to show these details.

Each digit (40) comprises a first half of light coloured plastics material ("y") and a second half of dark coloured plastics material ("x"). The chassis (38) is moulded from a corresponding colour dark or light plastics material. The first and second halves of the digit (40) are configured to form a passage over the axle (46) and are sonically welded into engagement over an axle (46). In the perspective view of FIG. 12 *c*, all of the digits are in place and rotated so that the light coloured half ("y") is facon forward.

In this embodiment, each digit (40) has a longitudinal recess formed between opposite halves with edges of the digit (40) on either side of the recesses providing an interference fit through the opening (45) in the chassis. This configuration serves to retain location of the digit (40) in an operative position within the opening (45).

In addition, variable description means (47) will be provided by stickers which are secured to the chassis (38), with cut-outs that fit around the digital-eights (39) of the pricing means. In this embodiment, these stickers include digital-eights of the kind for use with marker pens to indicate volume (in millilitres) and number of beverage units corresponding to a marked price.

In a variation of the digital-eight with pivotable digits, a chassis may be made of larger configuration to extend across three or more channels (29) of the kind illustrated. A single chassis may include only one digital-eight of this kind and more than one such insert used in combination to illustrate a price. Such inserts can be used next to other suitable strip material or chassis inserts or can be used with a poster engaged by the rails. Where a screen and/or poster are fitted to the frame, suitably positioned slits in the screen and/or poster can be provided (as cut-outs) which are aligned with the lipped flanges of the frame (and flanges of the inserts) into which the inserts are engageable. This will allow the digital-eight inserts to be fitted to the frame over the screen and/or poster.

In FIG. 13, the graphic inserts (30.3) are the same as in FIG. 11. The width of the chassis of the pricing inserts (30.4) is equivalent to three chassis (38) of the kind shown in FIG. 11.

Figure 14:
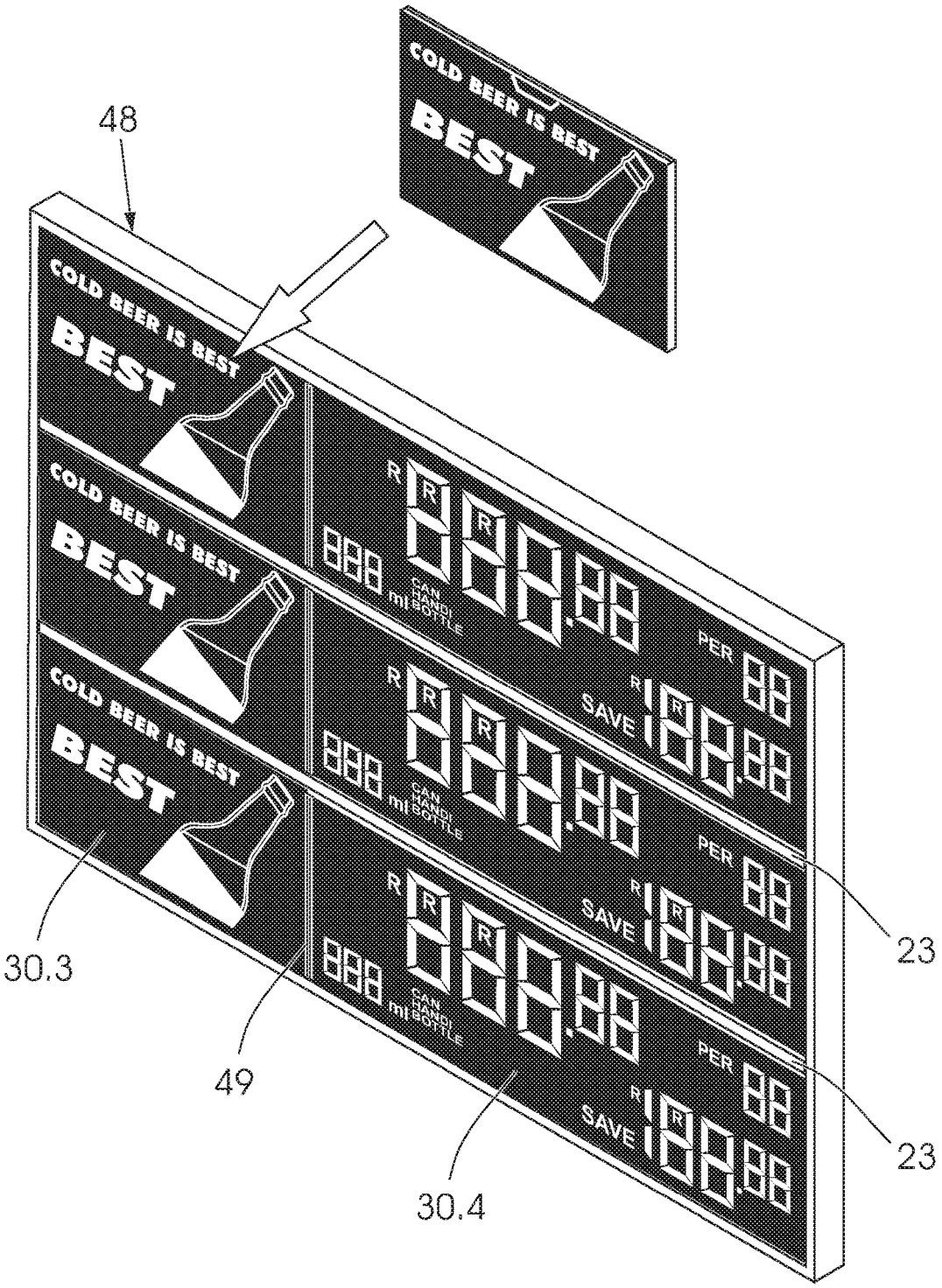
FIGS. 14 to 16 show an alternative frame with various arrangements of inserts.
Figure 15:
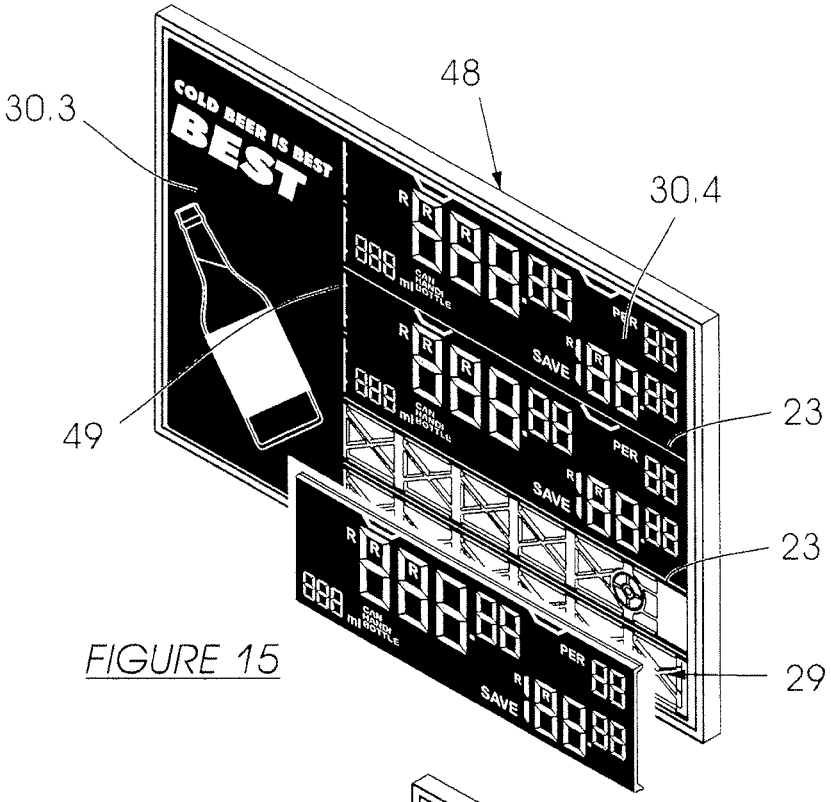
Figure 16:
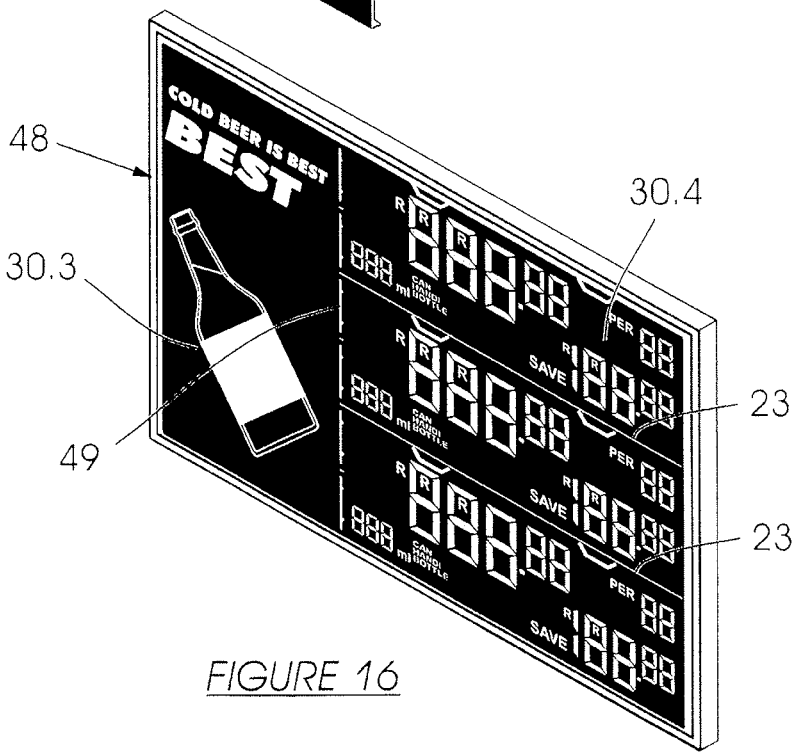

FIGS. 14 to 16 show an alternative display frame (48), without clamping-rails along its outer edges. A vertical rib (49) on the front side of the frame (48) separates the graphic inserts (30.3) from the pricing inserts (30.4). The display frame (48) of this embodiment is shown in FIG. 14 with graphic inserts (30.3) that are the same as those of the embodiments of FIGS. 11 and 13.

The pricing inserts (30.4) in FIGS. 14 and 15 are the same "wider" version illustrated in FIG. 13. The size and configuration of the lipped channels (29) [and the spacing of the flanges (23)] are the same as in the previous embodiments with the chassis (36; 38) extending across two adjacent channels (29). The body of the frame (48) also has the same upright connectors (22) and cross-bracing (25) providing a flat, perforated backing structure (26) between the transverse flanges (23).

In FIGS. 15 and 16, a larger graphic insert (30.3) replaces the smaller ones from FIG. 14. This insert (30.3) extends across six lipped channels (29). In FIG. 16, the previously described smaller pricing inserts (30.4) are used on this embodiment of the frame (48)—three inserts (30.4) are used in each row.

Figure 17:
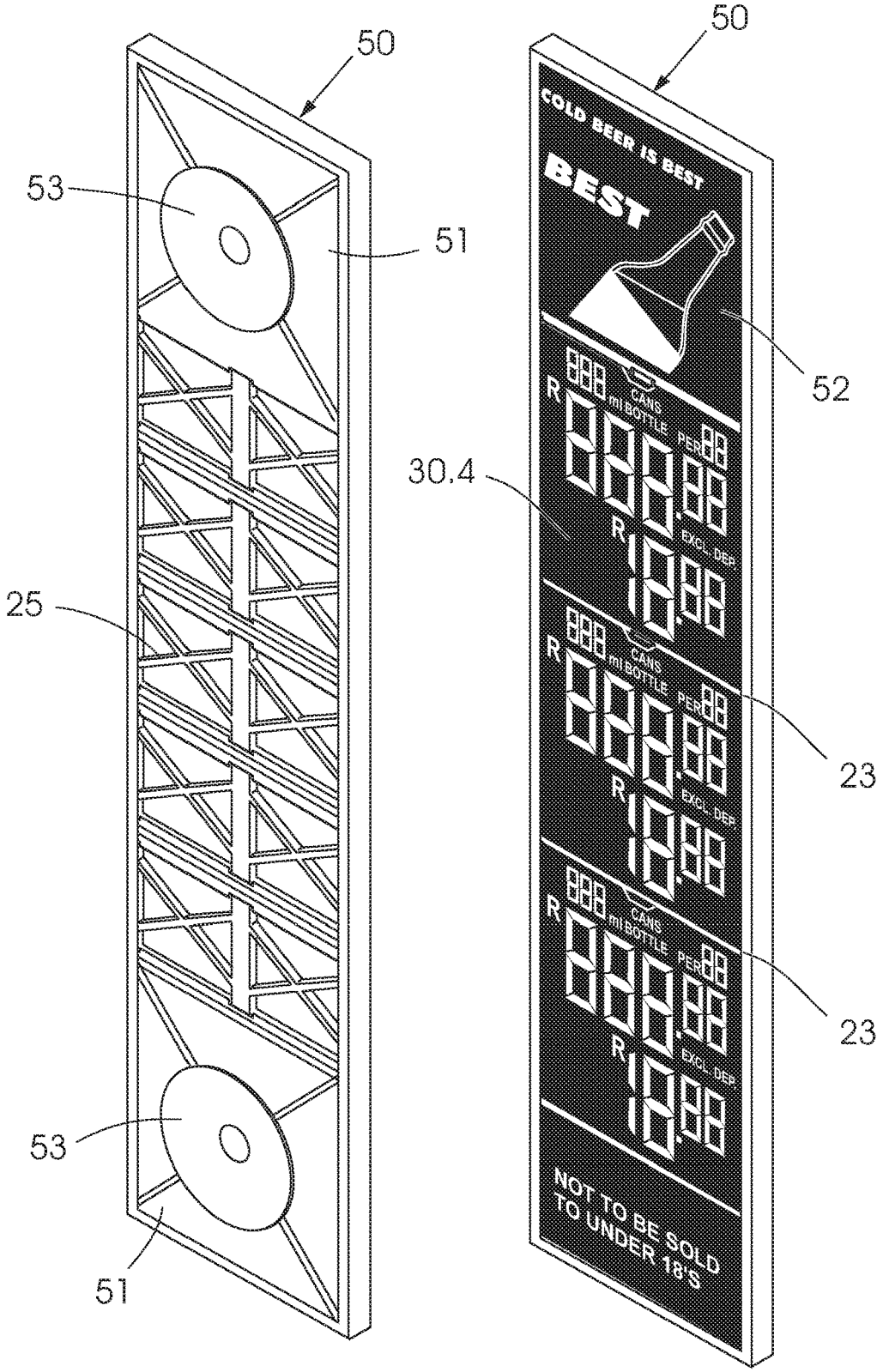
FIG. 17 shows still another version of a frame.

A further embodiment of a frame (50) is shown in FIG. 17. This frame (50) removably receives three variable pricing inserts (30.4) of the kind shown in FIG. 11, arranged in a column. The frame (50) includes six parallel channels (29) of the kind described in the frames (1; 48) above. The pricing inserts (30.4) each fit across two adjacent channels (29).

At the top and bottom ends of the frame (50) are panels (51) that carry adhesive stickers with graphics (52) in the form of branding. At a rear side of each panel (51) is a centrally located socket. Each of these receives a spigot on a suction cup (53). With the suctions cups (53) secured in place, the frame (50) is conveniently securable to a glass refrigerator door in a beverage retail outlet.

As additional features, the frame (1) shown in FIGS. 1 to 8 is moulded with four spaced apart bosses (60) on its rear side. The bosses (60) have openings through which screws can be secured from the front side. This allows for easy wall mounting with raw-bolts, for example. The bosses (60) can also be fitted with suction cups for window or glass fridge door mounting. A "press-out" spigot (61) is formed in the frame (1) adjacent each corner. These are moulded integrally but with thin sections of supporting material at either end. The spigots (61) have enlarged ends and are configured to be a press, interference fit into sockets (62) at the four corners on the back of the frame (1). In this manner, two frames (1) can be secured in back-to-back relationship, providing two outwardly facing "front" sides for display material.

In a further development of the frame illustrated in FIGS. 1 to 8, the peripheral ridges will be provided with spaced apart openings. An LED will be provided in each opening. At the rear side of the frame will be supported a suitable transformer or LED driver wired to the array of LEDs. In another example, the frame may be provided with LED or fluorescent backlighting. One convenient embodiment will incorporate a strip mounted LEDs along the ridges (3) in the recess (6) and a suitable refraction backlighting sheet (such as those made from acrylic) located against the front side of the frame body (2).

The frame of the invention in its various embodiments is suited for in-store pricing management systems or to advertise in-restaurant meal specials or beverage and meal combination specials. These frames could be also be used in kiosks, stalls, outdoors and for street pole advertisements. Cellular telephone network/data or Internet service providers can use the frames to display details of a number of package options or for one particular special on offer.

A durable product is provided which finds application in a number of industries. The product also affords a significant degree of flexibility in how it can be used with brand and pricing inserts or posters. Integrated lighting and other modifications for presentation and use of one or more frames has also been touched on.

A person skilled in the art will appreciate that a number of variations and modifications can be made to the features of the embodiment described without departing from the scope of the present invention.

The invention claimed is:

1. A display frame comprising a substantially planar body moulded from plastics material, with at least two oppositely disposed hingeable clamping-rails, the body including peripheral sidewalls for location of the clamping-rails, the clamping-rails each having a free, clamping edge and a hinged edge movably securable to the body with a lug formation, providing oppositely disposed first and second flanges, which locates through a slot provided between the body and sidewall, the first flange extending forwardly to engage an edge of the slot provided by the sidewall and the second flange extending through the slot to a rear side of the body with a spring biased cam formation which supports the second flanges in a position corresponding to a closed condition of respective of the clamping-rails and provides an interference path for the second flanges as the respective clamping-rails are moved from the closed condition towards an open condition, wherein the frame is traversed by spaced apart third flanges providing a plurality of parallel, lipped channels to removably receive inserts having edges locatable beneath lips of the channels.

2. The display frame as claimed in claim 1, wherein the third flanges of the channels are connected by a network of connectors providing perforated channel webs.

3. The display frame as claimed in claim 2, wherein a planar front facing surface provided by the connectors in the channels is formed by a first injection mould die and for overlying lips that extend along edges of the third flanges are formed by a second die which extends through the third flanges and connectors from a rear side of the frame.

4. The display frame as claimed in claim 1, wherein each of the clamping-rails has at least two lug formations and the cam formations are configured and arranged to act against the second flanges with a relatively small bias when the respective clamping-rails are in a closed condition and provide an increasing bias against movement of the respective clamping-rails towards the open condition.

5. The display frame as claimed in claim 4, wherein the cam formations provide a continuous resisting bias as the second flanges are moved towards an over-centre point and for the bias to switch towards movement of the second flanges into a position corresponding to the open conditions of the respective clamping-rails when the second flanges are moved past the over-centre point.

6. The display frame as claimed in claim 5, wherein the cam formations are each provided by a spring clip moulded integrally from resiliently flexible plastics material.

7. The display frame as claimed in claim 6, wherein the spring clips are moulded with a substantially flat base to one side, locatable against the frame body, and a rearwardly curved tongue providing the cam formation.

8. The display frame as claimed in claim 7, wherein the frame body has a spring clip mounting adjacent each slot with a stop arranged opposite the slot on the body to support the cam formation for interference engagement with the second flange and a pair of side-supported shoulders between the stop and the slot under which the spring clip is locatable with each spring clip having a rearwardly extending, transverse flange that locates against second lugs providing side-supported shoulders.

9. The display frame as claimed in claim 8, wherein the side-supported shoulders of the spring clip mountings are formed by a first die that extends through second slots in the body of the frame from a front side and the second lugs providing the side-supported shoulders are formed by a second die on the opposite, rear side of the frame.

10. The display frame as claimed in claim 1, wherein the clamping-rails are moulded from plastics material.

11. The display frame as claimed in claim 1, wherein the frame is rectangular and comprises four of the clamping-rails and four of the sidewalls, one of the clamping rails and one of the sidewalls being disposed along each edge of the frame.

12. The display frame as claimed in claim 1, wherein each of the clamping-rails comprises at least two lug formations, wherein the cam formation is configured and arranged to act against the rearward flange with a relatively small bias when the rearward flange is in the closed position, and to provide an increasing bias against movement of the rearward flange as it moves towards the open position.

13. The display frame as claimed in claim 12, wherein the cam formation is constructed and arranged to have an over-centre point, and the cam formation provides a continuous resisting bias as the rearward flange is moved from the closed position towards the over-centre point.

14. The display frame as claimed in claim 13, comprising a plurality of the resilient clips, wherein the substantially planar body comprises a plurality of resilient clip mountings for mounting the plurality of resilient clips, the plurality of resilient clip mountings being disposed adjacent respective of the plurality of slots, each of the resilient clip mountings, comprising (i) a stop disposed opposite one of the plurality of slots to support one of the plurality of cam formations for interference engagement with the respective rearward flanges of the plurality of resilient clips, (ii) a pair of second lugs disposed at opposite sides of the resilient clip mounting, and (iii) a pair of shoulders disposed between one of the plurality of stops and one of the plurality of slots, wherein each of the plurality of resilient clips comprises a T-shaped flange that extends rearward from the resilient clip and laterally from a central portion of the resilient clip, each of the resilient clips being constructed and arranged such that, with the T-shaped flange of the resilient clip abutting the second lugs, the resilient clip can be biased into place on one of the plurality of resilient clip mountings with the resilient clip disposed against a pair of the plurality of stops.

15. The display frame as claimed in claim 14, wherein each of the resilient clips is integrally formed from resilient plastics material.

16. A display frame comprising:

a substantially planar body moulded from plastics material, the substantially planar body comprising a front side, a rear side, a first flange on the front side and a plurality of sidewalls, each of the plurality of sidewalls forming with the first flange a recess comprising a plurality of slots;

a resilient clip comprising a cam formation, the resilient clip and the substantially planar body collectively comprising means for mounting the clip to the rear side of the body in any of a plurality of positions with the cam formation of the clip disposed adjacent one of the plurality of slots in the recess;

a plurality of clamping-rails, each of the plurality of clamping-rails comprising a lug with the lug comprising a forward flange and a rearward flange projecting from a first end of the clamping-rail in different directions and a rib projecting from a second end of the clamping-rail, the plurality of clamping-rails being hingeably attachable to the body with first and second of the plurality of clamping-rails on opposite sides of the body and with the lug of each of the plurality of clamping-rails disposed through a slot in the recess with the rearward flange of the lug in a position to interact with the cam formation when the clip is mounted to the body; each of the plurality of clamping-rails being constructed and arranged such that, with the lug disposed through the slot in the recess and the rearward flange in position to interact with the cam formation, the rearward flange is slidable along the cam formation between a closed position wherein the cam formation biases the rearward flange to a position in which the forward flange is disposed against one of the plurality of sidewalls and the rib is disposed against the first flange, and an open position wherein the cam formation biases the rearward flange to a position in which the rib is spaced from the first flange.

17. The display frame as claimed in claim 16, wherein the substantially planar body comprises third flanges that are spaced from each other and that form channels having lips to receive inserts.

18. The display frame as claimed in claim 17, wherein the substantially planar body comprises a network of connectors forming perforated channel webs, the network of connectors connecting the third flanges.

19. The display frame as claimed in claim 18, wherein the rear side of the substantially planar body comprises a backing structure comprising a planar surface and overlying lips that extend along the third flanges.

* * * * *